US007619598B2

(12) United States Patent
Pulvirenti et al.

(10) Patent No.: US 7,619,598 B2
(45) **Date of Patent: *Nov. 17, 2009**

(54) DRIVER FOR AN OLED PASSIVE-MATRIX DISPLAY

(75) Inventors: Francesco Pulvirenti, Acireale (IT); Gregorio Bontempo, Barcellona Pozzo di Gotto (IT); Murakata Masaki, Yamagata (JP); Hayafuji Akinori, Yamagata (JP)

(73) Assignee: STMicroelectronics S.r.l., Agrate Brianza (IT)

( * ) Notice: Subject to any disclaimer, the term of this patent is extended or adjusted under 35 U.S.C. 154(b) by 574 days.

This patent is subject to a terminal disclaimer.

(21) Appl. No.: 11/546,516

(22) Filed: Oct. 10, 2006

(65) Prior Publication Data

US 2007/0171155 A1 Jul. 26, 2007

Related U.S. Application Data

(63) Continuation of application No. PCT/IT2004/000191, filed on Apr. 8, 2004.

(51) Int. Cl.
*G09G 3/32* (2006.01)
*G09G 3/18* (2006.01)
*G09G 3/38* (2006.01)

(52) U.S. Cl. ..... 345/82; 345/52; 345/211

(58) Field of Classification Search ..... 345/52, 345/76–82, 211; 315/169.1–169.3, 291; 713/300, 320, 340
See application file for complete search history.

(56) References Cited

U.S. PATENT DOCUMENTS

| | | | | |
|---|---|---|---|---|
| 5,594,463 | A | 1/1997 | Sakamoto | |
| 6,747,617 | B1 * | 6/2004 | Kawashima | 345/76 |
| 7,009,603 | B2 * | 3/2006 | Page et al. | 345/211 |
| 2002/0175634 | A1 | 11/2002 | Ishizuka et al. | |
| 2006/0028150 | A1 * | 2/2006 | Vitunic et al. | 315/248 |
| 2009/0128045 | A1 * | 5/2009 | Szczeszynski et al. | 315/185 R |

FOREIGN PATENT DOCUMENTS

| | | | |
|---|---|---|---|
| EP | 1341147 | A2 | 9/2003 |
| GB | 2389952 | A | 12/2003 |
| WO | 03/107313 | A2 | 12/2003 |

* cited by examiner

*Primary Examiner*—Kevin M Nguyen
*Assistant Examiner*—Matthew A Fry
(74) *Attorney, Agent, or Firm*—Lisa K. Jorgenson; Robert Iannucci; Seed IP Law Group PLLC

(57) ABSTRACT

An OLED (organic light-emitting diode) passive-matrix display includes a display portion and a driver portion. The display portion includes a matrix of OLEDs for displaying information. The driver portion includes a monitor circuit and a voltage adjusting circuit. The voltage adjusting circuit has a power-up portion that generates a supply voltage based on a reference voltage. In response to an indication to switch modes, the voltage adjusting circuit switches to an operational mode wherein the supply voltage is generated based on the maximum voltage drop read across the OLEDs.

22 Claims, 3 Drawing Sheets

DRIVER FOR AN OLED PASSIVE-MATRIX DISPLAY

BACKGROUND OF THE INVENTION

1. Field of the Invention

The present invention relates to displays, and more particularly to a driver for an Organic Light-Emitting Diode (OLED) passive-matrix display.

2. Description of the Related Art

Liquid crystal displays (LCDs) are the most common type of flat-panel display used today. One drawback, however, to LCDs is that they require a separate light source, typically a fluorescent backlight, to illuminate the panel. In fact, the LCD's brightness depends solely on its backlight and it is this backlight that limits the life of the LCD.

Because of these drawbacks, OLED displays are gaining in popularity. OLED displays are self-luminous and, therefore, do not require a separate backlight. Passive-matrix OLED displays have a simple structure and are well suited for low-cost and low-information-content applications, such as alphanumeric displays. Active-matrix OLEDs have an integrated electronic backplane that enables high-resolution, high-information-content applications, including videos and graphics. In any event, the OLED displays are very thin, compact displays with wide viewing angles (up to 180 degrees), fast response, high resolution, and good display qualities.

The basic OLED cell includes a stack of thin organic layers sandwiched between an anode and a metallic cathode. The organic layers generally include a hole-injection layer, a hole-transport layer, an emissive layer, and an electron-transport layer. The emissive layer is primarily responsible for the light generation or electroluminescence. Specifically, when an appropriate voltage is applied to the cell, the injected positive and negative charges recombine in the emissive layer to produce light. The structure of the organic layers, of the anode and cathode is designed to maximize the recombination process in the emissive layer, thereby maximizing the light output from the OLED display.

The light output or brightness of an OLED display is directly proportional to current flow. Additionally, the impedance of the OLEDs drops exponentially with an increasing forward voltage (VF). Thus, as impedance drops, light output increases rapidly and there is virtually no delay between the generation of current flow and the generation of light output.

One problem with OLED displays is the variation of the current-voltage (I-V) characteristics over time, which causes degradation of the luminance efficiency and pixel-to-pixel luminance uniformity. Several factors contribute to this variation in the I-V characteristics including operating temperature, external light (e.g., sunlight), pixel position on the display, etc. The driving method also affects the I-V characteristics. For example, in an OLED passive-matrix display, one method used is called multiplexing line address (MLA), wherein the average current needed to bias the OLED is multiplied by the duty cycle of the row to compute an equivalent multiplexing current, which may be 50 to 200 times the average bias current (1 μA to 1 mA from dim to bright) depending on the number of rows and the efficiency of material. Such high currents cause excess voltage drops on the OLEDs that results in wasted power consumption.

International application WO 03/107313A2 to Cambridge Display Technology Limited discloses a technique to reduce power consumption in an active-matrix display by using current and voltage sensors and by controlling an adjustable power supply that adjusts the voltage in response to the sensed voltage. However, this application only discloses indirectly measuring voltage and current used by the display pixels, which is less desirable. Additionally, there is no well-defined technique disclosed for efficient power-up of the OLED display. That is, when the display is first powered on, the pixels are off and the required voltage needed by the OLED display is not well defined.

Thus, there is a need for a display that can efficiently bring the OLEDs through a power-up mode and allow for adjustment of the power levels supplied to the OLEDs after the power-up mode has been completed.

BRIEF SUMMARY OF THE INVENTION

In order to overcome the deficiencies of the prior art, an OLED passive-matrix display is disclosed that allows for an efficient power-up mode of operation, as well as the ability to adjust power (e.g., voltage and/or current) supplied to the OLEDs based on need during normal, steady-state conditions.

In one embodiment, the OLED passive-matrix display includes a monitor circuit that monitors the real-time voltage levels used by the OLEDs and a voltage adjusting circuit that changes the supply voltage in response to signals received from the monitor circuit. During a power-up mode, the voltage adjusting circuit uses a fixed reference voltage as a basis for generating supply voltage when the power needed by the OLEDs is not well defined. But after a predetermined period of time or in response to an external signal, the voltage adjusting circuit switches from reading the fixed reference voltage to reading a variable voltage level supplied from the monitor circuit. This variable voltage is based on voltage readings of the OLEDs, such as reading the voltage drops directly across the OLEDs. In response to this variable voltage level, the voltage adjusting circuit modifies the voltage supplied to the OLEDs. In this way, there is no wasted power dissipation and the circuit has real-time tracking of all the OLEDs.

BRIEF DESCRIPTION OF THE SEVERAL VIEWS OF THE DRAWINGS

One example embodiment of the present invention is now described, which proceeds with reference to the following drawings.

DETAILED DESCRIPTION OF THE INVENTION

Figure 1:
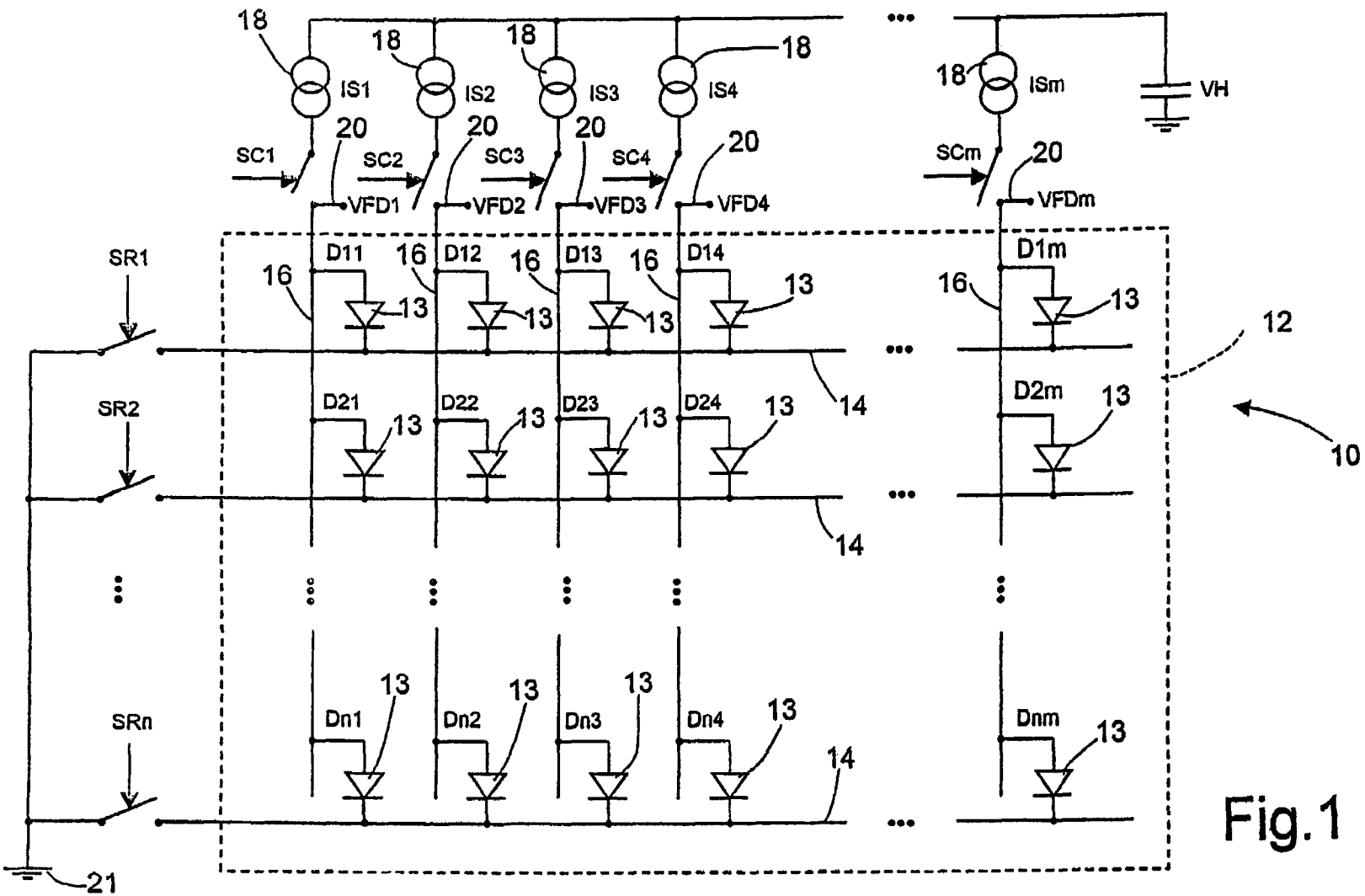
FIG. 1 is a circuit diagram of a display portion of an OLED passive-matrix display.

FIG. 1 shows a display portion 10 of an OLED passive-matrix display. A matrix 12 of OLEDs 13 includes parallel rows 14 of conductors positioned orthogonally to parallel columns 16 of conductors. Each row 14 includes OLED Dx1 to Dxm (where x is the row number and m is the number of columns), and each column 16 includes OLEDs D1*x* to Dnx (where n is the number of rows and x is the column number). Each column is biased with a current generator 18 (1 to m) coupled at its upstream end to a voltage source VH and at its downstream end to one of the column switches SC1-SCm. Each row 14 includes one of the row switches SR1-SRn with its upstream end coupled to the OLEDs, and its downstream end coupled to a cathode 21. Column switches SC1-SCm and row switches SR1-SRn are independently switchable so that each OLED can be selected individually irrespective of the other OLEDs. To measure voltage directly across the OLEDs, voltage taps 20 are coupled to the columns as indicated at VFD1-VFDm. These voltage taps 20 may be coupled upstream or downstream of the switches SC1-SCm, and the taps 20 can be used to read the OLED voltages externally.

The voltage source VH must have a high enough voltage to account for the OLED "ON" voltage, the voltage drop on the rows 14 and columns 16, the voltage saturation of the current generators 18, and the voltage drop on the switches (SC1-SCm and SR1-SRn). A driver circuit, not shown in FIG. 1 but described below, is used to generate the power supplied from the voltage source VH.

In operation, the display portion 10 performs a scan operation wherein one row is activated at a time through successive activation of switches SR1-SRn. However, the frequency is such that the activation and deactivation of the OLEDs is not detectable to the human eye. Because only one of the row switches SR1-SRn is activated at a time, the voltage taps 20 are used to read a voltage drop directly across one OLED in a column at a time. Such a direct measurement is a very accurate way of determining the voltage used by each OLED in the display.

Figure 2:
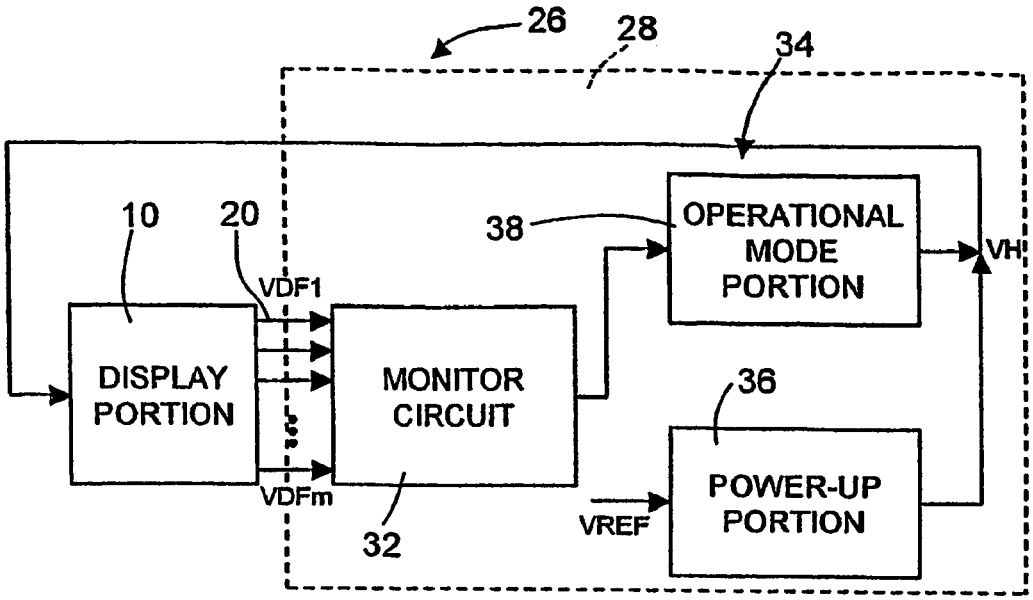
FIG. 2 is a high-level block diagram of an OLED passive-matrix display according to one example embodiment of the invention.

FIG. 2 is a high-level block diagram of an OLED passive-matrix display 26 including the display portion 10 and a driver portion 28. The driver portion 28 includes a monitor circuit 32 and a voltage adjusting circuit 34. The monitor circuit 32 is coupled through voltage taps 20 to the display portion 10.

The voltage adjusting circuit 34 includes two portions: a power-up portion 36 (also called power-up means) and an operational-mode portion 38 (also called operational-mode means).

The power-up portion 36 is used by the voltage adjusting circuit 34 when the OLED passive-matrix display 26 is first powered on. A reference voltage Vref is supplied to the power-up portion and this reference voltage is used to generate the supply voltage VH during a first period of time. After a predetermined period of time or in response to an external signal, the voltage adjusting circuit 34 switches from using the power-up portion 36 to using the operational-mode portion 38 in order to generate the supply voltage. The voltage adjusting circuit 34, during this second period of time, reads voltage supplied from the monitor circuit 32 in order to generate the supply voltage. The power-up portion 36 and operational-mode portion 38 are coupled together at a supply node VH used to supply power to the display portion 10 as shown in FIG. 1.

Figure 3:
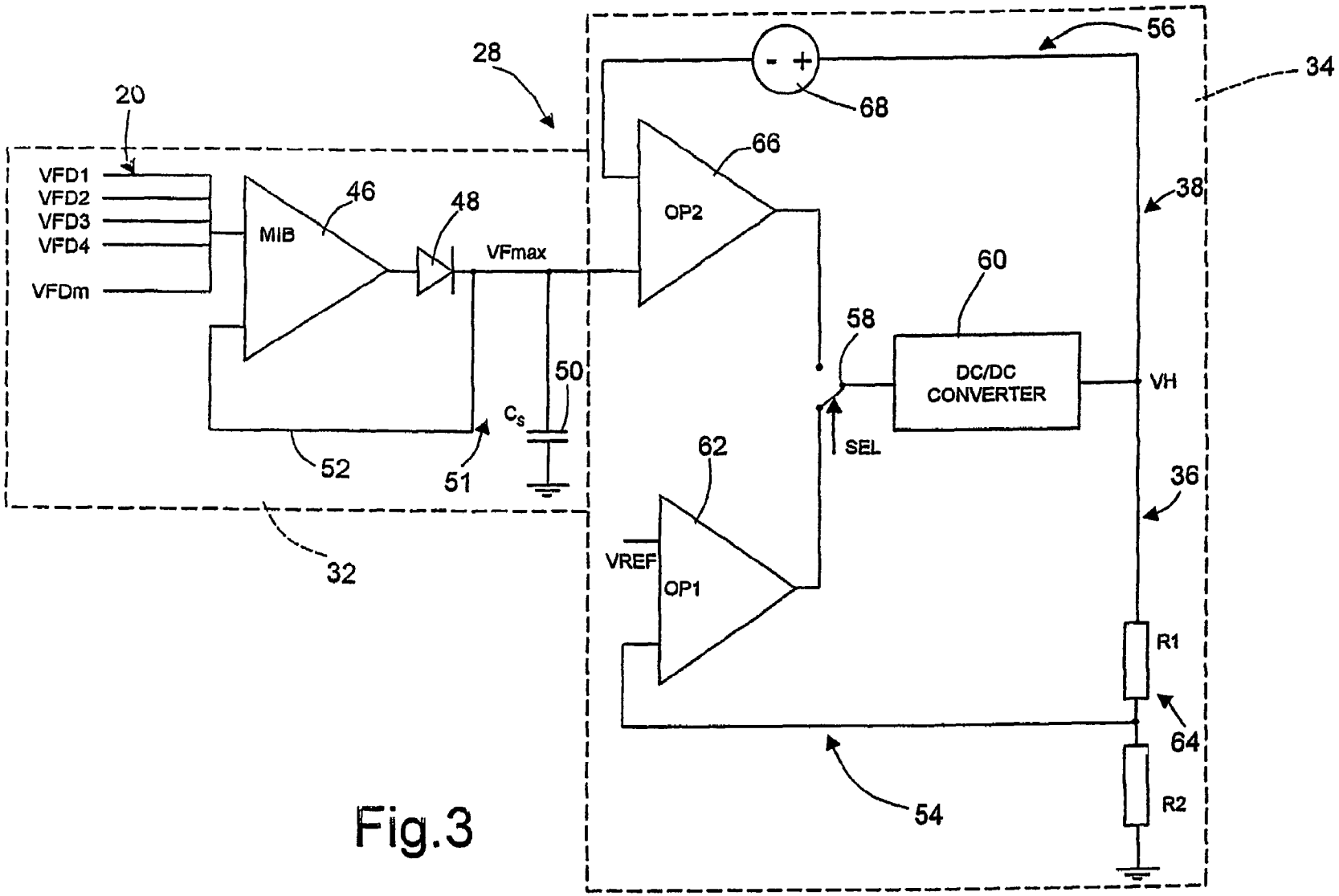
FIG. 3 is a detailed circuit diagram showing further features of the block diagram of FIG. 2.

FIG. 3 is an example embodiment showing a detailed circuit schematic of the driver portion 28 of the OLED passive-matrix display 26. The voltage taps 20 (from FIG. 1) are coupled, such as through direct connection, to a multiple-input buffer 46 as indicated by VFD1-VFDm. The buffer 46 is a simple buffer with "m" differential stages connected in parallel (multiple gates with sources and drains in common). A diode 48, capacitor 50 and the buffer 46 together function as a peak detector 51 to detect the maximum voltage drop across the OLEDs 13 (FIG. 1). This maximum voltage drop is fed back to the multiple-input buffer 46, as indicated at 52, for purposes of storage. The voltage on the capacitor 50 is designated as Vfmax and represents the maximum voltage drop across all of the pixels (i.e., OLEDs) in the display. The size of the capacitor varies depending on the design, but an example value can be in the range of 100-300 nf. The voltage adjusting circuit 34 includes two parallel circuit loops 54, 56 sharing a common switch 58 (which allows alternate selection of the circuit loops), a DC/DC converter 60, and the voltage supply node VH (which is coupled to the current generators 18 in FIG. 1).

The first circuit loop 54 corresponds to the power-up portion 36 (FIG. 2) and includes an operational amplifier 62 having an output coupled to the switch 58 and having a non-inverting input coupled to the reference voltage VREF. An example value of VREF is 1.25 volts, but this value varies based on the design. A resistor divider circuit 64, including R1 and R2, is used to provide a percentage of the supply voltage VH to the inverting input of the operational amplifier 62. The values of R1 and R2 vary depending on the design, but an example ratio of R1/R2 is between 10 and 20.

The second circuit loop 56 corresponds to the operational-mode portion 38 (FIG. 2) and includes a second operational amplifier 66 having a non-inverting input coupled to the capacitor 50, which supplies the maximum voltage read across the OLEDs 13. The operational amplifier 66 also has an inverting input coupled to the voltage supply node VH through a voltage offset 68. The voltage offset 68 takes into account the saturation range of the current generators 18 of the display 26 and may be externally controlled through a digital-to-analog converter (not shown). Thus, the voltage supplied by the voltage adjusting circuit 34 is proportional to the maximum voltage read across the OLEDs plus the voltage offset 68.

Figure 4:
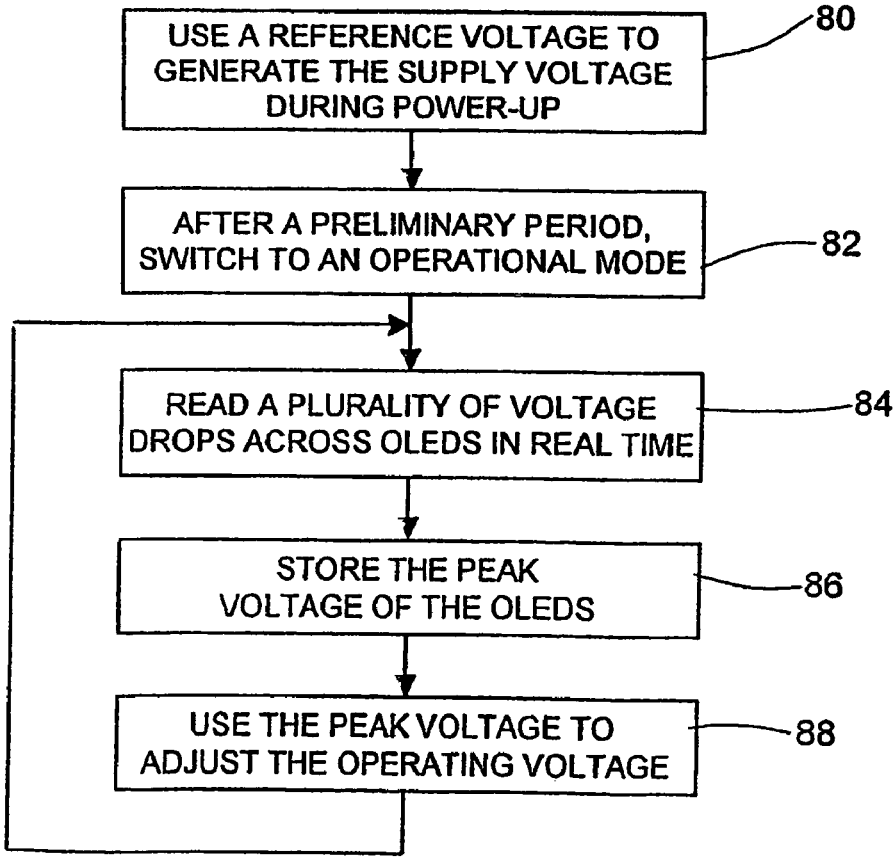
FIG. 4 is a flowchart of a method for operating the OLED passive-matrix display.

FIG. 4 is a flowchart of a method for operating the OLED display. In process box 80, the voltage adjusting circuit 34 uses a reference voltage (VREF) to generate the supply voltage during a power-up mode of operation. In process box 82, after a preliminary period, the voltage adjusting circuit 34 switches from the power-up mode to an operational mode by switching switch 58. There are many ways to control such a switch 58 as is well understood in the art. For example, an external processor can control the switch based on conditions of the display, or a timer can provide a signal after a predetermined period of time to control the switch.

In process box 84, the monitor circuit 32 reads the voltage drops directly across the OLEDs. Such a reading is performed in real-time during the operation of the display. In process box 86, a peak voltage of the OLEDs is stored. Thus, the maximum voltage used by any OLED in the OLED display is stored on the capacitor 50. In process box 88, the peak voltage is used by the voltage adjusting circuit 34 to either adjust or maintain the currently supplied voltage on supply node VH.

In light of the above description, it is clear that numerous modifications and variants can be made to the device and to the method described and illustrated herein, all falling within the scope of the invention, as defined in the attached claims.

For example, although a particular display portion is shown in FIG. 1, the monitor circuit may be used to read other types of display portions used in passive-matrix OLED displays. Additionally, although a particular type of peak detector is used, those skilled in the art recognize that a wide variety of peak voltage detectors may be used. Still further, although voltage is monitored from the columns, the circuit may easily be arranged to monitor voltage across each pixel individually. Finally, although each OLED is monitored in the above-described design, it will be recognized that less than all of the OLEDs may be monitored if desired.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The invention claimed is:

1. An organic light-emitting diode (OLED) passive-matrix display, comprising:

a plurality of column conductors extending in a first direction;

a plurality of row conductors extending in a second direction transverse to the first direction;

a plurality of OLEDs, each associated with a column and a row to allow selection of the OLED;

a monitor circuit coupled to the OLEDs to detect a voltage drop across the OLEDs; and a voltage adjusting circuit to supply power to the OLEDs, the voltage adjusting circuit being coupled to the monitor circuit and configured to have two modes of operation: a power-up mode where a reference voltage is used by the voltage adjusting circuit to supply power to the OLEDs and an operational mode where a variable voltage supplied from the monitor circuit is used by the voltage adjusting circuit to supply power to the OLEDs wherein the voltage adjusting circuit includes:

a supply node from which voltage can be supplied to the OLEDs; and first and second circuit loops, which are alternatively selectable, the first circuit loop, when selected, coupling the reference voltage to the supply node and the second circuit loop, when selected, coupling the monitor circuit to the supply node and wherein the first and second circuit loops have a common portion that includes a DC-to-DC converter, a switch, and the supply node, the DC-to-DC converter being coupled between the switch and supply node.

2. The OLED passive-matrix display according to claim 1, wherein the voltage adjusting circuit comprises a power-up mode means for receiving the reference voltage and for generating a first power supply quantity, and an operational mode means for receiving said voltage drop and for generating a second power supply quantity.

3. The OLED passive-matrix display of claim 1, wherein the switch is structured to alternately select the circuit loops.

4. The OLED passive-matrix display of claim 1, wherein the first circuit loop includes a resistor divider and an operational amplifier with the resister divider coupled to one input of the operational amplifier and the reference voltage coupled to a second input of the operational amplifier.

5. The OLED passive-matrix display of claim 1, wherein the second circuit loop includes an operational amplifier with one input coupled to the monitor circuit and a second input coupled to the supply node.

6. The OLED passive-matrix display of claim 5, further including a voltage offset coupled between the second input and the supply node.

7. The OLED passive-matrix display of claim 1, wherein the monitor circuit includes a peak detector to detect a maximum voltage used by the OLEDs.

8. The OLED passive-matrix display of claim 7, wherein the peak detector includes a multiple-input buffer coupled to the OLEDs to read the voltage drops across the OLEDs and a capacitor coupled to an output of the multiple-input buffer to store the maximum voltage used by the OLEDs.

9. A driver circuit for an organic light-emitting diode (OLED) passive-matrix display that includes a plurality of OLEDs, the driver circuit comprising:

a monitor circuit coupled to the OLEDs to detect a voltage drop across the OLEDs; and a voltage adjusting circuit to supply power to the OLEDs, the voltage adjusting circuit being coupled to the monitor circuit and configured to have two modes of operation: a power-up mode where a reference voltage is used by the voltage adjusting circuit to supply power to the OLEDs and an operational mode where a variable voltage supplied from the monitor circuit is used by the voltage adjusting circuit to supply power to the OLEDs wherein the voltage adjusting circuit includes:

a supply node from which voltage can be supplied to the OLEDs; and first and second circuit loops, which are alternatively selectable, the first circuit loop, when selected, coupling the reference voltage to the supply node and the second circuit loop, when selected, coupling the monitor circuit to the supply node and wherein the first and second circuit loops have a common portion that includes a DC-to-DC converter, a switch, and the supply node, the DC-to-DC converter being coupled between the switch and supply node.

10. The driver circuit of claim 9, wherein the voltage adjusting circuit comprises a power-up mode means for receiving the reference voltage and for generating a first power supply quantity, and an operational mode means for receiving said voltage drop and for generating a second power supply quantity.

11. The driver circuit of claim 9, wherein the switch is structured to alternately select the circuit loops.

12. The driver circuit of claim 9, wherein the first circuit loop includes a resistor divider and an operational amplifier with the resister divider coupled to one input of the operational amplifier and the reference voltage coupled to a second input of the operational amplifier.

13. The driver circuit of claim 9, wherein the second circuit loop includes an operational amplifier with one input coupled to the monitor circuit and a second input coupled to the supply node.

14. The driver circuit of claim 13, further including a voltage offset coupled between the second input and the supply node.

15. The driver circuit of claim 9, wherein the monitor circuit includes a peak detector to detect a maximum voltage used by the OLEDs.

16. The driver circuit of claim 15, wherein the peak detector includes a multiple-input buffer coupled to the OLEDs to read the voltage drops across the OLEDs and a capacitor coupled to an output of the multiple-input buffer to store the maximum voltage used by the OLEDs.

17. A voltage adjusting circuit for supplying power to an organic light-emitting diode (OLED) passive-matrix display that includes a plurality of OLEDs and a monitor circuit coupled to the OLEDs to detect a voltage drop across the OLEDs, the voltage adjusting circuit being configured to have two modes of operation: a power-up mode where a reference voltage is used by the voltage adjusting circuit to supply power to the OLEDs and an operational mode where a variable voltage supplied from the monitor circuit is used by the voltage adjusting circuit to supply power to the OLEDs, the voltage adjusting circuit comprising:

a supply node from which voltage can be supplied to the OLEDs; and first and second circuit loops, which are alternatively selectable, the first circuit loop, when selected, coupling the reference voltage to the supply node and the second circuit loop, when selected, coupling the monitor circuit to the supply node and wherein the first and second circuit loops have a common portion that includes a DC-to-DC converter, a switch, and the supply node, the DC-to-DC converter being coupled between the switch and supply node.

18. The voltage adjusting circuit of claim 17, further comprising a power-up mode means for receiving the reference voltage and for generating a first power supply quantity, and an operational mode means for receiving said voltage drop and for generating a second power supply quantity.

19. The voltage adjusting circuit of claim 17, wherein the switch is structured to alternately select the circuit loops.

20. The voltage adjusting circuit of claim 17, wherein the first circuit loop includes a resistor divider and an operational amplifier with the resister divider coupled to one input of the operational amplifier and the reference voltage coupled to a second input of the operational amplifier.

21. The voltage adjusting circuit of claim 17, wherein the second circuit loop includes an operational amplifier with one input coupled to the monitor circuit and a second input coupled to the supply node.

22. The driver circuit of claim 21, further including a voltage offset coupled between the second input and the supply node.

* * * * *